US009968829B2

(12) United States Patent
Watanabe et al.

(10) Patent No.: US 9,968,829 B2
(45) Date of Patent: May 15, 2018

(54) MULTI-PIECE SOLID GOLF BALL

(71) Applicant: Bridgestone Sports Co., Ltd., Tokyo (JP)

(72) Inventors: Hideo Watanabe, Chichibushi (JP); Katsunori Sato, Chichibushi (JP)

(73) Assignee: Bridgestone Sports Co., Ltd., Minato-ku, Tokyo (JP)

( * ) Notice: Subject to any disclaimer, the term of this patent is extended or adjusted under 35 U.S.C. 154(b) by 0 days. days.

(21) Appl. No.: 15/287,050

(22) Filed: Oct. 6, 2016

(65) Prior Publication Data

US 2017/0136312 A1 May 18, 2017

(30) Foreign Application Priority Data

Nov. 12, 2015 (JP) ..... 2015-221950

(51) Int. Cl.
*A63B 37/00* (2006.01)
*A63B 37/02* (2006.01)

(52) U.S. Cl.
CPC ..... *A63B 37/0076* (2013.01); *A63B 37/0022* (2013.01); *A63B 37/0063* (2013.01); *A63B 37/0065* (2013.01); *A63B 37/0077* (2013.01); *A63B 37/0087* (2013.01); *A63B 37/0092* (2013.01)

(58) Field of Classification Search
CPC ..... A63B 37/0075; A63B 37/0076; A63B 37/0063; A63B 37/0065; A63B 37/0087; A63B 2037/0079
See application file for complete search history.

(56) References Cited

U.S. PATENT DOCUMENTS

| | | | | |
|---|---|---|---|---|
| 6,210,295 | B1 * | 4/2001 | Yoneyama | A63B 37/12 473/351 |
| 7,115,049 | B2 | 10/2006 | Sullivan et al. | |
| 7,267,621 | B2 | 9/2007 | Sullivan et al. | |
| 7,503,855 | B2 | 3/2009 | Sullivan et al. | |
| 8,393,978 | B2 | 3/2013 | Watanabe et al. | |
| 8,702,535 | B2 | 4/2014 | Sullivan et al. | |
| 2007/0265113 | A1 * | 11/2007 | Hirau | A63B 37/0031 473/376 |
| 2007/0270244 | A1 * | 11/2007 | Sullivan | A63B 37/0003 473/377 |

(Continued)

FOREIGN PATENT DOCUMENTS

JP 2011-120898 A 6/2011

*Primary Examiner* — John E Simms, Jr.
(74) *Attorney, Agent, or Firm* — Sughrue Mion, PLLC

(57) ABSTRACT

In a multi-piece solid golf ball having a two-layer core consisting of an inner layer and an outer layer, a cover, at least one intermediate layer between the core and the cover, and a paint film layer formed on the cover surface, each layer of the two-layer core is formed primarily of a rubber composition, the intermediate layer and the cover are each formed primarily of a resin material, the core has a hardness profile which satisfies specific conditions, and the sphere consisting of the core encased by the intermediate layer has a higher surface hardness than the ball. When used by mid- to high-level golfers, this ball achieves sufficient reduction in the spin rate on full shots with a driver, enabling the distance to be increased, and the spin performance on approach shots is excellent, enhancing the enjoyability of the game.

16 Claims, 4 Drawing Sheets

(56) References Cited

U.S. PATENT DOCUMENTS

| | | | | |
|---|---|---|---|---|
| 2008/0161132 | A1* | 7/2008 | Sullivan | A63B 37/0062 473/376 |
| 2010/0160087 | A1* | 6/2010 | Nakamura | A63B 37/0003 473/375 |
| 2012/0010021 | A1* | 1/2012 | Fushihara | A63B 37/0063 473/372 |
| 2012/0252604 | A1* | 10/2012 | Okabe | A63B 37/0063 473/376 |
| 2012/0264542 | A1* | 10/2012 | Matsuyama | C08G 18/4854 473/374 |
| 2013/0225333 | A1* | 8/2013 | Umezawa | A63B 37/0004 473/374 |
| 2013/0288824 | A1* | 10/2013 | Isogawa | A63B 37/0059 473/373 |
| 2014/0100059 | A1* | 4/2014 | Kimura | A63B 37/0081 473/374 |
| 2014/0187353 | A1* | 7/2014 | Nakamura | A63B 37/0087 473/374 |

* cited by examiner 6864N (700kgf)

1961N (200kgf)

MULTI-PIECE SOLID GOLF BALL

CROSS-REFERENCE TO RELATED APPLICATION

This non-provisional application claims priority under 35 U.S.C. § 119(a) on Patent Application No. 2015-221950 filed in Japan on Nov. 12, 2015, the entire contents of which are hereby incorporated by reference.

TECHNICAL FIELD

The present invention relates to a multi-piece solid golf ball which has a two-layer core consisting of a rubber inner layer and a rubber outer layer, a cover, and at least one intermediate layer between the core and the cover.

BACKGROUND ART

Recently, a variety of golf balls have been proposed that aim to achieve certain intended spin properties and increase the distance traveled by the ball, both by providing the ball with a multilayer structure and also by imparting the core that makes up most of the ball with a specific hardness profile in such a way as to optimize the core hardness profile and the overall hardness and thickness parameters of the ball. Art which provides the core of a golf ball with a two-layer structure and satisfies a desired core hardness profile has hitherto been proposed. Golf balls in which the core is made of two layers are described in, for example, U.S. Pat. Nos. 7,115,049, 7,267,621, 7,503,855 and 8,702,535.

However, none of these patent publications specify the relationship between the deflections of the inner core layer and the outer core layer when subjected to specific loading, nor have the core hardness profiles in any of these disclosures been fully optimized. Hence, mid- to high-level golfers and professionals with intermediate to high head speeds have awaited the emergence of new golf balls containing a two-layer core that can achieve an even longer distance and that are also able to maintain the spin performance on approach shots at a high level, thus further increasing the enjoyability of the game.

SUMMARY OF THE INVENTION

It is therefore an object of this invention to provide a multi-piece solid golf ball which, when used by mid- to high-level amateur golfers and professionals having intermediate to high head speeds, makes it possible to achieve a lower spin rate and a high initial velocity on full shots, enabling a good distance to be obtained on shots with a driver (W#1), and which moreover, in order to increase the enjoyability of the game, also enables the spin performance on approach shots to be maintained at a high level.

As a result of extensive investigations, we have discovered that, in the construction of a multi-piece solid golf ball which has a core, a cover and at least one intermediate layer therebetween, and which additionally has a paint film layer formed on the surface of the cover, significant benefits are obtained by integrally and comprehensively designing the ball construction such that:

(a) the core is made of rubber and has a two-layer structure that is soft on the inside and hard on the outside;

(b) materials composed primarily of synthetic resins are used as the intermediate layer and cover materials;

(c) in the core hardness profile, the hardness gradients between the JIS-C hardness at the center of the inner core layer (Cc), the JIS-C hardness at a position 10 mm from the center of the inner core layer (C10), the JIS-C hardness at the surface of the inner core layer (Cs) and the JIS-C hardness at the surface of the outer core layer (Css) satisfy specific relationships; and (d) the surface hardness of the sphere consisting of the core encased by the intermediate layer is higher than the surface hardness of the ball.

When such a golf ball is used by high-level amateur golfers and professionals, owing to synergistic effects by the two-layer core having a hard interior and a soft exterior and by the two-layer cover having a hard interior and a soft exterior, it is possible to sufficiently lower the spin rate of the ball on full shots and yet maintain a high level of spin performance on approach shots, thus achieving both of these ball properties. What is specifically meant here by satisfying specific relationships in the core hardness gradients is to provide a hardness profile that, in the overall core consisting of an inner layer and an outer layer, is flat at the center portion and has a steep gradient on the outside. As used herein, "mid- to high-level golfer" refers to golfers having head speeds (HS) of generally 40 to 50 m/s, with mid-level golfers having head speeds of about 40 to 48 m/s and high-level golfers having head speeds of about 42 to 50 m/s.

Accordingly, the invention provides a multi-piece solid golf ball having a two-layer core consisting of an inner layer and an outer layer, a cover, at least one intermediate layer between the core and the cover, and a paint film layer formed on a surface of the cover, wherein each layer of the two-layer core is formed primarily of a rubber composition; the intermediate layer and the cover are each formed primarily of a resin material; the core has a hardness profile which satisfies the conditions:

$$Css-Cc \geq 25, \text{ and} \quad \text{(i)}$$

$$(Css-C10)/(C10-Cc) \geq 5.0, \quad \text{(ii)}$$

where Cc is the JIS-C hardness at a center of the inner core layer, C10 is the JIS-C hardness at a position 10 mm from the center of the inner core layer, Cs is the JIS-C hardness at a surface of the inner core layer, and Css is the JIS-C hardness at a surface of the outer core layer; and a sphere consisting of the core encased by the intermediate layer has a surface hardness which is higher than a surface hardness of the ball.

In a preferred embodiment of the golf ball of the invention, the core hardness profile also satisfies the following condition:

$$Cs-Cc \geq 20. \quad \text{(iii)}$$

In another preferred embodiment of the inventive golf ball, the core hardness profile further satisfies the conditions:

$$0 \leq C10-Cc \leq 10, \text{ and} \quad \text{(iv)}$$

$$20 \leq Css-C10, \quad \text{(v)}$$

with the provisos that Css≥80 and Cc≥50.

In the inventive golf ball, (Css−C10)/(C10−Cc) in condition (ii) of the core hardness profile may have an upper limit value of 10.

In the inventive golf ball, Css−Cc in condition (i) of the core hardness profile may have an upper limit value of 45.

In yet another preferred embodiment of the inventive golf ball, the core hardness profile also satisfies the condition:

$$(C10-C5) \leq (C5-Cc) \leq (C15-C10), \quad \text{(vi)}$$

where C5 is the JIS-C hardness at a position 5 mm from the center of the inner core layer, and C15 is the JIS-C hardness at a position 15 mm from the center of the inner core layer.

In a further preferred embodiment of the inventive golf ball, letting E be the deflection of the inner core layer, F be the deflection of the core having an inner layer and an outer layer, G be the deflection of the sphere consisting of the core encased by the intermediate layer and H be the deflection of the golf ball when respectively compressed under a final load of 1,275 N from an initial load of 98 N, the golf ball satisfies the relationship:

$$E/G \leq 2.0,$$

and may also satisfy the following three relationships:

$$E/F \leq 1.5$$

$$E/H \leq 2.1, \text{ and}$$

$$E-H \leq 2.5.$$

In a further preferred embodiment, the golf ball satisfies the condition:

$$PS_7/S/H \times 100 \geq 6.70(\text{mm}^{-1}),$$

where $PS_7$ is the pressed area ($mm^2$), defined as the area of the ball that comes into contact with a flat surface when the ball is subjected to a load of 6,864 N (700 kgf), S is the hypothetical planar area ($mm^2$) of the ball, defined as the area of a cross-sectional circle along the ball diameter were the surface of the ball to be entirely free of dimples, and H is the deflection (mm) of the ball when compressed under a final load of 1,275 N from an initial load of 98 N.

In a still further preferred embodiment, the golf ball satisfies the condition:

$$PS_2/S/H \times 100 \geq 1.90(\text{mm}^2),$$

where $PS_2$ is the pressed area ($mm^2$), defined as the area of the ball that comes into contact with a flat surface when the ball is subjected to a load of 1,961 N (200 kgf), S is the hypothetical planar area ($mm^2$) of the ball, defined as the area of a cross-sectional circle along the ball diameter were the surface of the ball to be entirely free of dimples, and H is the deflection (mm) of the ball when compressed under a final load of 1,275 N from an initial load of 98 N.

In yet another preferred embodiment of the inventive golf ball, the paint film layer has an elastic work recovery of from 70 to 98%.

Advantageous Effects of the Invention

The multi-piece solid golf ball of the invention, particularly when used by a mid- to high-level golfer, can fully achieve a spin rate reduction on full shots with a driver (W#1) and so is capable of traveling an increased distance, and also has a high level of spin performance on approach shots, thus making the game more enjoyable.

DESCRIPTION OF THE DIAGRAMS

DETAILED DESCRIPTION OF THE INVENTION

The objects, features and advantages of the invention will become more apparent from the following detailed description, taken in conjunction with the foregoing diagrams.

Figure 1:
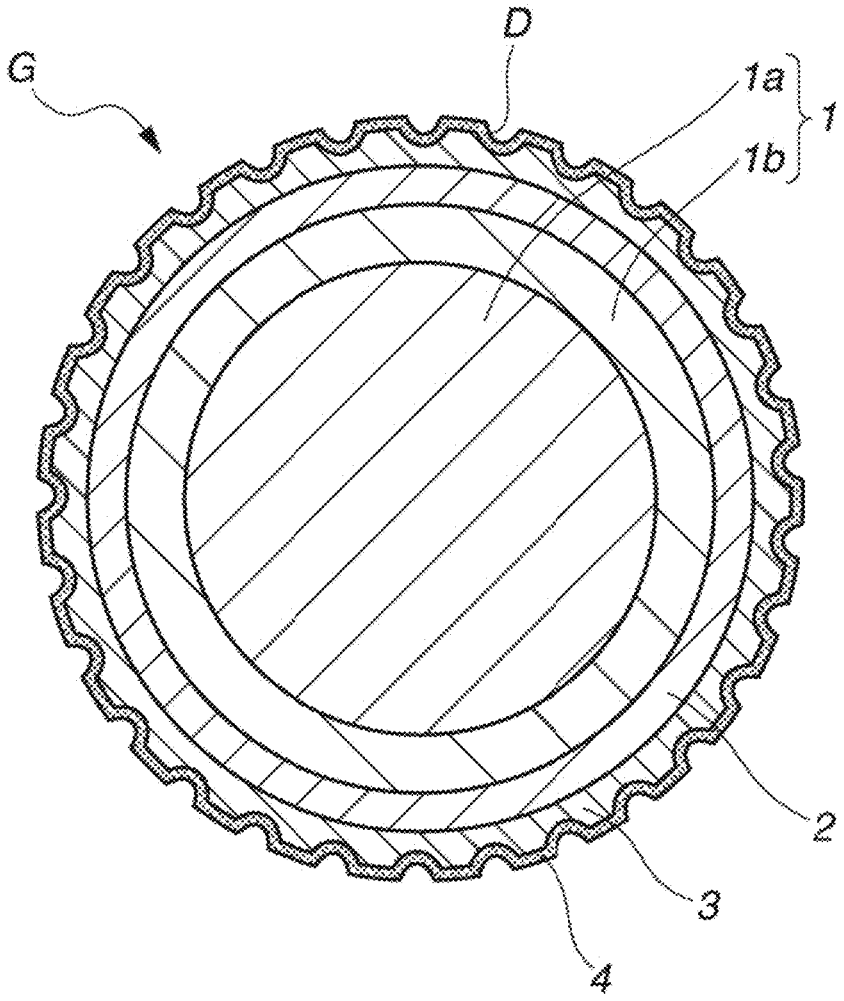
FIG. 1 is a schematic cross-sectional view of a golf ball in an embodiment of the invention.

The multi-piece golf ball of the invention has, in order from the inside to the outside: a core with an inner layer and an outer layer, an intermediate layer, a cover, and a paint film layer. Referring to FIG. 1, which shows the internal structure in one embodiment of the golf ball of the invention, the golf ball G has a core 1 with an inner core layer 1*a* and an outer core layer 1*b*, an intermediate layer 2 encasing the core 1, and a cover 3 encasing the intermediate layer 2. A paint film layer 4 is formed on the surface of the cover. Numerous dimples D are typically formed on the surface of the cover 3 in order to improve the aerodynamic properties of the ball. The respective layers are described in detail below.

The core, as mentioned above, is formed as two layers: an inner layer and an outer layer. The inner core layer has a diameter of preferably from 20 to 40 mm, more preferably from 30 to 38 mm, and even more preferably from 35 to 35.5 mm. When the diameter of the inner core layer is too small, the initial velocity of the ball on shots with a driver (W#1) is low, as a result of which the intended distance may not be obtained. On the other hand, when the diameter of the inner core layer is too large, the durability to cracking on repeated impact may worsen or the spin rate-lowering effect on full shots may be inadequate, as a result of which the intended distance may not be obtained.

The center hardness (Cc) of the inner core layer described below (also referred to as "the core center hardness") and the cross-sectional hardnesses at specific positions refer to hardnesses measured at the center and specific positions in a cross-section obtained by cutting the core in half through the center. The surface hardness (Cs) refers to the hardness measured at the surface (spherical surface) of the inner core layer. The subsequently described surface hardness (Css) refers to the surface hardness of the outer core layer.

The center hardness of the inner core layer (Cc), expressed in terms of JIS-C hardness, is preferably at least 50, more preferably from 51 to 59, and even more preferably from 52 to 57. When the center hardness of the inner core layer is too large, the spin rate may rise excessively, as a result of which a good distance may not be achieved, and the ball may have a hard feel at impact. On the other hand, when the center hardness is too small, the durability to cracking on repeated impact may worsen and the feel of the ball at impact may be too soft.

The JIS-C hardness at a position 5 mm from the center of the inner core layer (C5) is preferably from 52 to 66, more preferably from 54 to 62, and even more preferably from 56 to 60. The JIS-C hardness at a position 10 mm from the center of the inner core layer (C10) is preferably from 53 to 67, more preferably from 55 to 63, and even more preferably from 57 to 61. When these hardness values are too large, the spin rate may rise excessively, as a result of which a good distance may not be obtained, or the feel at impact may be hard. On the other hand, when these values are too small, the durability to cracking on repeated impact may worsen and the feel at impact may be too soft.

The JIS-C hardness at a position 15 mm from the center of the inner core layer (C15) is preferably from 64 to 80, more preferably from 67 to 77, and even more preferably from 70 to 74. When this hardness value is too high, the feel at impact may be hard and the durability to cracking on repeated impact may worsen. On the other hand, when this hardness value is too low, the spin rate may rise excessively and the rebound may decrease, as a result of which a good distance may not be obtained.

The surface hardness of the inner core layer (Cs), expressed in terms of JIS-C hardness, is preferably from 70 to 91, more preferably from 74 to 89, and even more preferably from 77 to 87. When this hardness value is too large, the durability to cracking on repeated impact may worsen. On the other hand, when this hardness value is too small, the spin rate on full shots may rise and the intended distance may not be obtained.

The C10−Cc value is preferably from 0 to 10, more preferably from 1 to 8, and even more preferably from 2 to 6. This value means that, from the center of the inner core layer out to about 10 mm, the hardness gradient is gradual. The C5−Cc value is preferably from −1 to 9, more preferably from 0 to 7, and even more preferably from 1 to 5. When this value is too large, the initial velocity on full shots may be low and the intended distance may not be obtained. On the other hand, when this value is too small, the spin rate on full shots may be high and the intended distance may not be obtained.

The C10−C5 value is preferably from −2 to 6, more preferably from −1 to 4, and even more preferably from 0 to 2. The C15−C10 value is preferably from 4 to 22, more preferably from 7 to 18, and even more preferably from 10 to 15. When these hardness differences fall outside of the above ranges, the spin rate on full shots may rise excessively and a good distance may not be obtained, or the durability to cracking on repeated impact may worsen.

The hardness difference between the surface hardness of the inner core layer and the center hardness of the inner core layer (Cs−Cc), expressed in terms of JIS-C hardness, is preferably from 20 to 40, more preferably from 22 to 35, and even more preferably from 24 to 30. When this hardness difference is too large, the initial velocity on full shots may decrease and the intended distance may not be obtained, or the durability to cracking on repeated impact may worsen. On the other hand, when this hardness difference is too small, the spin rate on full shots may rise excessively and the intended distance may not be achieved.

The inner core layer having the above hardness profile is preferably made of a material that is composed primarily of rubber. For example, use may be made of a rubber composition obtained by compounding (A) a base rubber as the chief component and (B) an organic peroxide, and also a co-crosslinking agent, an inert filler and, optionally, an organosulfur compound.

A polybutadiene is preferably used as the base rubber (A). The polybutadiene has a cis-1,4 bond content on the polymer chain of typically at least 60 wt %, preferably at least 80 wt %, more preferably at least 90 wt %, and most preferably at least 95 wt %. When the content of cis-1,4 bonds among the bonds on the polybutadiene molecule is too low, the resilience may decrease.

Rubber components other than this polybutadiene may be included in the base rubber (A) within a range that does not detract from the advantageous effects of the invention. Examples of such rubber components other than the foregoing polybutadiene include other polybutadienes, and diene rubbers other than polybutadiene, such as styrene-butadiene rubber, natural rubber, isoprene rubber and ethylene-propylene-diene rubber.

The organic peroxide (B) used in the invention is not particularly limited, although the use of an organic peroxide having a one-minute half-life temperature of 110 to 185° C. is preferred. One, two or more organic peroxides may be used. The amount of organic peroxide included per 100 parts by weight of the base rubber is preferably at least 0.1 part by weight, and more preferably at least 0.3 part by weight. The upper limit is preferably not more than 5 parts by weight, more preferably not more than 4 parts by weight, and even more preferably not more than 3 parts by weight. A commercially available product may be used as the organic peroxide. Specific examples include those available under the trade names Percumyl D, Perhexa C-40, Niper BW and Peroyl L (all from NOF Corporation), and Luperco 231XL (from Atochem Co.).

The co-crosslinking agent is exemplified by unsaturated carboxylic acids and the metal salts of unsaturated carboxylic acids. Illustrative examples of unsaturated carboxylic acids include acrylic acid, methacrylic acid, maleic acid and fumaric acid. Acrylic acid and methacrylic acid are especially preferred. Metal salts of unsaturated carboxylic acids are not particularly limited, and are exemplified by those obtained by neutralizing the foregoing unsaturated carboxylic acids with the desired metal ions. Illustrative examples include the zinc salts and magnesium salts of methacrylic acid and acrylic acid. The use of zinc acrylate is especially preferred.

These unsaturated carboxylic acids and/or metal salts thereof are included in an amount per 100 parts by weight of the base rubber which is typically at least 10 parts by weight, preferably at least 15 parts by weight, and more preferably at least 20 parts by weight. The upper limit is typically not more than 60 parts by weight, preferably not more than 50 parts by weight, more preferably not more than 45 parts by weight, and most preferably not more than 40 parts by weight. When too much is included, the feel of the ball may become too hard and unpleasant. When too little is included, the rebound may decrease.

To satisfy the desired hardness profile described above, the inner core layer is preferably formed of a material molded under heat from a rubber composition which includes as the essential ingredients: (A) a base rubber, (B) an organic oxide, and (C) water and/or a metal monocarboxylate.

Decomposition of the organic peroxide within the inner core layer formulation can be promoted by the direct addition of water (or a water-containing material) to the inner core layer material. It is known that the decomposition efficiency of the organic peroxide within a rubber composition changes with temperature and that, starting at a given temperature, the decomposition efficiency rises with increasing temperature. If the temperature is too high, the amount of decomposed radicals rises excessively, leading to recombination between radicals and, ultimately, deactivation. As a result, fewer radicals act effectively in crosslinking. Here, when a heat of decomposition is generated by decomposition of the organic peroxide at the time of inner core layer vulcanization, the vicinity of the inner core layer surface remains at substantially the same temperature as the temperature of the vulcanization mold, but due to the build-up of heat of decomposition by the organic peroxide which has decomposed from the outside, the temperature near the center of the inner core layer becomes considerably higher than the mold temperature. In cases where water (or a water-containing material) is added directly to the inner core layer, because the water acts to promote decomposition of the organic peroxide, radical reactions like those described above can be made to differ at the center and surface of the inner core layer. That is, decomposition of the organic peroxide is further promoted near the center of the inner core layer, bringing about greater radical deactivation, which leads to a further decrease in the amount of effective radicals. As a result, it is possible to obtain an inner core layer in which the crosslink densities at the center and the surface differ markedly. It is also possible to obtain an inner core layer having different dynamic viscoelastic properties at the center thereof. Along with achieving a lower spin rate, golf balls having such an inner core layer are also able to exhibit excellent durability and undergo less change over time in rebound. In particular, when such a golf ball is used by professionals and mid- to high level amateur golfers having intermediate to high head speeds, adding water to the inner core layer-forming rubber composition enables a reduced spin rate on full shots to be fully achieved. When zinc monoacrylate is used instead of the above water, water is generated from the zinc monoacrylate by heat during kneading of the compounding materials. An effect similar to that obtained by the addition of water can thereby be obtained.

Components (A) and (B) have already been described above.

The water serving as component (C) is not particularly limited, and may be distilled water or tap water. The use of distilled water which is free of impurities is especially preferred. The amount of water included per 100 parts by weight of the base rubber is preferably at least 0.1 part by weight, and more preferably at least 0.3 part by weight. The upper limit is preferably not more than 5 parts by weight, and more preferably not more than 4 parts by weight.

By including a suitable amount of such water, the moisture content in the rubber composition prior to vulcanization becomes preferably at least 1,000 ppm, and more preferably at least 1,500 ppm. The upper limit is preferably not more than 8,500 ppm, and more preferably not more than 8,000 ppm. When the moisture content of the rubber composition is too low, it may be difficult to obtain a suitable crosslink density and tan δ, which may make it difficult to mold a golf ball having little energy loss and a reduced spin rate. On the other hand, when the moisture content of the rubber composition is too high, the core may end up too soft, which may make it difficult to obtain a suitable core initial velocity.

It is also possible to add water directly to the rubber composition. The following methods (i) to (iii) may be employed to include water:

(i) applying steam or ultrasonically applying water in the form of a mist to some or all of the rubber composition (compounded material);
(ii) immersing some or all of the rubber composition in water;
(iii) letting some or all of the rubber composition stand for a given period of time in a high-humidity environment in a place where the humidity can be controlled, such as a constant humidity chamber.

As used herein, "high-humidity environment" is not particularly limited, so long as it is an environment capable of moistening the rubber composition, although a humidity of from 40 to 100% is preferred.

Alternatively, the water may be worked into a jelly state and added to the above rubber composition. Or a material obtained by first supporting water on a filler, unvulcanized rubber, rubber powder or the like may be added to the rubber composition. In such a form, the workability is better than when water is added directly to the composition, enabling the efficiency of golf ball production to be increased. The type of material in which a given amount of water has been included, although not particularly limited, is exemplified by fillers, unvulcanized rubbers and rubber powders in which sufficient water has been included. The use of a material which causes no loss of durability or resilience is especially preferred. The moisture content of the above inner core layer material is preferably at least 3 wt %, more preferably at least 5 wt %, and even more preferably at least 10 wt %. The upper limit is preferably not more than 99 wt %, and even more preferably not more than 95 wt %.

In this invention, a metal monocarboxylate may be used instead of the above-described water. Metal monocarboxylates, in which the carboxylic acid is presumably coordination-bonded to the metal, are distinct from metal dicarboxylates such as zinc diacrylate of the formula $(CH_2{=}CHCOO)_2Zn$. A metal monocarboxylate introduces water into the rubber composition by way of a dehydration/condensation reaction, and thus provides an effect similar to that of water. Moreover, because a metal monocarboxylate can be added to the rubber composition as a powder, the operations can be simplified and uniform dispersion within the rubber composition is easy. A monosalt is required in order to carry out the above reaction effectively. The amount of metal monocarboxylate included per 100 parts by weight of the base rubber is preferably at least 1 part by weight, and more preferably at least 3 parts by weight. The upper limit in the amount of metal monocarboxylate included is preferably not more than 60 parts by weight, and more preferably not more than 50 parts by weight. When the amount of metal monocarboxylate included is too small, it may be difficult to obtain a suitable crosslink density and tan δ, as a result of which a sufficient golf ball spin rate-lowering effect may not be achievable. On the other hand, when too much is included, the inner core layer may become too hard, as a result of which it may be difficult for the ball to maintain a suitable feel at impact.

The carboxylic acid used may be, for example, acrylic acid, methacrylic acid, maleic acid, fumaric acid or stearic acid. Examples of the substituting metal include sodium, potassium, lithium, zinc, copper, magnesium, calcium, cobalt, nickel and lead, although the use of zinc is preferred. Illustrative examples of the metal monocarboxylate include zinc monoacrylate and zinc monomethacrylate, with the use of zinc monoacrylate being especially preferred.

Production of the inner core layer may be carried out in the usual manner by molding the inner core layer as a spherical molded article using heat and compression under vulcanization conditions of from 140° C. to 180° C. and from 10 minutes to 60 minutes.

The vulcanized inner core layer preferably has a higher moisture content at the center than at the surface. The moisture content of the molded inner core layer can be suitably controlled by adjusting such conditions as the amount of water included in the rubber composition, the molding temperature and the molding time.

The thickness of the outer core layer, although not particularly limited, is preferably from 0.5 to 6.0 mm, more preferably from 1.0 to 5.0 mm, and even more preferably from 1.5 to 4.0 mm. When the outer core layer is too thick, the initial velocity on full shots may decrease, as a result of which the intended distance may not be obtained. On the other hand, when the outer core layer is too thin, the durability to cracking on repeated impact worsens and the spin rate-lowering effect on full shots may be inadequate, as a result of which the intended distance may not be obtained.

The surface hardness of the outer core layer (Css), expressed in terms of JIS-C hardness, is preferably at least 80, more preferably from 81 to 95, and even more preferably from 82 to 93. When the surface hardness of this outer core layer is too large, the feel at impact may harden or the durability to cracking on repeated impact may worsen. On the other hand, when this value is too small, the spin rate may rise excessively and the rebound may decrease, possibly resulting in a poor distance.

The hardness difference between the surface hardness of the outer core layer and the center hardness of the inner core layer (Css−Cc), expressed in terms of JIS-C hardness, must be at least 25, and is preferably from 28 to 45, and more preferably from 30 to 40. When this hardness difference is too large, the durability to cracking on repeated impact worsens. On the other hand, when this hardness difference is too small, the spin rate rises excessively, resulting in a poor distance.

The Css−C10 value is preferably at least 20, more preferably from 22 to 40, and even more preferably from 25 to 35. This means that from a position 10 mm from the center of the inner core layer out to the surface of the outer core layer, there exists a steep gradient which, in terms of JIS-C hardness, exceeds 20. When this value is too large, the curability to cracking on repeated impact may worsen or the feel at impact may worsen. On the other hand, when this value is too small, the spin rate-lowering effect on full shots may be inadequate, as a result of which the intended distance may not be obtained.

The Css−C10 value is preferably larger than the C10−Cc value. This means that, in the core hardness profile, the outer portion of the core has a steeper gradient than the inner portion. When the Css−C10 value is smaller than the C10−Cc value, the spin rate-lowering effect on full shots may be inadequate, as a result of which the intended distance may not be obtained.

In order to design the hardness profile of the overall core consisting of an inner layer and an outer layer such that the center portion is flat and the outer portion of the core has a steep gradient, the (Css−C10)/(C10−Cc) value must be at least 5.0, and is preferably from 5 to 14, more preferably from 6 to 12, and even more preferably from 7 to 10. When this value is too large, the durability to cracking on repeated impact may worsen. On the other hand, when this value is too small, the spin rate-lowering effect on full shots may be inadequate, as a result of which the desired distance may not be achieved.

In the above core hardness profile, it is preferable for the following relationship to be satisfied.

$$(C10-C5)\leq(C5-Cc)\leq(C15-C10)$$

Outside of this relationship, the spin rate-lowering effect on full shots may be inadequate, or the initial velocity of the ball when struck may be low, as a result of which the intended distance may not be achieved.

The outer core layer material may be composed primarily of a rubber material, and may be the same as or different from the inner core layer material. Specifically, a rubber composition can be prepared using a base rubber as the chief component and including, together with this, other ingredients such as a co-crosslinking agent, an organic peroxide, an inert filler and an organosulfur compound. The method used to encase the inner core layer with an outer core layer may involve forming a pair of half-cups from unvulcanized rubber sheet, placing and enclosing the inner core layer within the pair of half-cups, then molding under heat and pressure. For example, advantageous use may be made of a process in which initial vulcanization (semi-vulcanization) is carried out to produce a pair of hemispherical cups, following which an inner core layer is placed in one of the hemispherical cups and covered by the other hemispherical cup, and secondary vulcanization (complete vulcanization) is subsequently carried out. Another preferred production process involves forming the rubber composition while in an unvulcanized state into sheets so as to make a pair of outer core layer sheets, and shaping the sheets with a die having a hemispherical protrusion so as to produce unvulcanized hemispherical cups. The pair of hemispherical cups is then placed over a prefabricated inner core layer and formed into a spherical shape under heating and compression at a temperature of 140 to 180° C. for a period of 10 to 60 minutes.

The inner core layer has a deflection (mm) when compressed under a final load of 1,2750 (130 kgf) from an initial load of 98 N (10 kgf) which, although not particularly limited, is preferably from 3.6 to 5.1 mm, more preferably from 3.9 to 4.8 mm, and even more preferably from 4.2 to 4.5 mm. The sphere consisting of the inner core layer encased by the outer core layer, i.e., the overall core, has a deflection (mm) when compressed under a final load of 1,275 (130 kgf) from an initial load of 98 N (10 kgf) which, although not particularly limited, is preferably from 3.1 to 4.2 mm, more preferably from 3.3 to 4.0 mm, and even more preferably from 3.5 to 3.8 mm. When this value is too large, the feel at impact may be too soft and the durability to repeated impact may worsen, or the initial velocity on full shots may be lower, as a result of which the intended viscosity may not be obtained. On the other hand, when this value is too small, the feel at impact may be too hard or the spin rate on full shots may rise, as a result of which the intended distance may not be obtained.

In addition, letting the above deflection (mm) of the inner core layer be E and the above deflection (mm) of the sphere consisting of the inner core layer encased by the outer core layer be F, the value E/F is preferably not more than 1.5, more preferably from 0.8 to 1.4, and even more preferably from 1.0 to 1.3. When this value is too small, the feel at impact may be too hard and the spin rate on full shots may rise excessively, as a result of which the intended distance on shots with a driver (W#1) may not be obtained. On the other hand, when the value E/F is too large, the feel at impact may be too soft, the initial velocity on full shots may be low, and the intended distance on shots with a driver (W#1) may not be obtained.

Next, the intermediate layer is described.

The intermediate layer has a material hardness, expressed in terms of Shore D hardness, which, although not particularly limited, is preferably from 57 to 67, more preferably from 59 to 65, and even more preferably from 61 to 63. The sphere consisting of the core encased by the intermediate layer, referred to below as the "intermediate layer-encased sphere," has a surface hardness, expressed in terms of Shore D hardness, which is preferably from 63 to 74, more preferably from 65 to 72, and even more preferably from 67 to 70. When the intermediate layer is too soft, the spin rate on full shots may rise excessively, as a result of which a good distance may not be achieved. On the other hand, when the intermediate layer is too hard, the durability to cracking on repeated impact may worsen and the feel of the ball on shots with a putter or on short approaches may become too hard.

The intermediate layer-encased sphere has a deflection (mm) when compressed under a final load of 1,275 N (130 kgf) from an initial load of 98 N (10 kgf) which, although not particularly limited, is preferably from 2.4 to 3.6 mm, more preferably from 2.6 to 3.4 mm, and even more preferably from 2.8 to 3.1 mm. When this value is too large, the feel of the ball may be too soft, the durability to repeated impact may be poor, and the initial velocity on full shots may be low, as a result of which the intended distance may not be achieved. On the other hand, when this value is too small, the feel of the ball may be too hard and the spin rate on full shots may rise, as a result of which the intended distance may not be achieved.

The intermediate layer has a thickness of preferably from 0.8 to 2.1 mm, more preferably from 1.0 to 1.7 mm, and even more preferably from 1.2 to 1.4 mm. The thickness of the intermediate layer is preferably higher than the thickness of the subsequently described cover (outermost layer). When the intermediate layer thickness falls outside of this range or is thinner than the cover, the spin rate-lowering effect on shots with a driver (W#1) may be inadequate, as a result of which a good distance may not be achieved.

The intermediate layer material is not particularly limited, although preferred use can be made of various thermoplastic resin materials. To fully achieve the desired effects of the invention, it is especially preferable to use a high-resilience resin material as the intermediate layer material. For example, the use of an ionomer resin material or a highly neutralized resin material such as that described in JP-A 2011-120898 is preferred.

A non-ionomeric thermoplastic elastomer may be included in the intermediate layer material. The non-ionomeric thermoplastic elastomer is preferably included in an amount of from 1 to 50 parts by weight per 100 parts by weight of the combined amount of the base resins.

The non-ionomeric thermoplastic elastomer is exemplified by polyolefin elastomers (including polyolefins and metallocene-catalyzed polyolefins), polystyrene elastomers, diene polymers, polyacrylate polymers, polyamide elastomers, polyurethane elastomers, polyester elastomers and polyacetals.

Optional additives may be suitably included in the intermediate layer material according to the intended use. For example, various additives such as pigments, dispersants, antioxidants, ultraviolet absorbers and light stabilizers may be added. When such additives are included, the content thereof per 100 parts by weight of the combined amount of the base resins is preferably at least 0.1 part by weight, and more preferably at least 0.5 part by weight, with the upper limit being preferably not more than 10 parts by weight, and more preferably not more than 4 parts by weight.

It is desirable to abrade the surface of the intermediate layer in order to increase adhesion with the polyurethane that is preferably used in the subsequently described cover (outermost layer). In addition, it is desirable to apply a primer (adhesive) to the surface of the intermediate layer following such abrasion treatment or to add an adhesion reinforcing agent to the intermediate layer material.

The intermediate layer material has a specific gravity which is typically less than 1.1, preferably from 0.90 to 1.05, and more preferably from 0.93 to 0.99. Outside of this range, the rebound becomes small, as a result of which a good distance may not be obtained, or the durability to cracking on repeated impact may worsen.

Next, the cover, which is the outermost layer of the ball, is described.

The cover (outermost layer) has a material hardness, expressed in terms of Shore D hardness, which, although not particularly limited, is preferably from 30 to 58, more preferably from 35 to 54, and even more preferably from 40 to 50.

The cover-encased sphere, i.e., the ball, has a surface hardness, expressed in terms of Shore D hardness, which is preferably from 38 to 70, more preferably from 43 to 66, and even more preferably from 48 to 62. When the ball is softer than this range, the spin rate on driver (W#1) shots and iron shots may become too high, as a result of which a good distance may not be obtained. When the cover is harder than this range, the spin rate on approach shots may be inadequate or the feel at impact may be too hard.

The cover (outermost layer) has a thickness which, although not particularly limited, is preferably from 0.3 to 1.5 mm, more preferably from 0.45 to 1.2 mm, and even more preferably from 0.6 to 0.9 mm. When the thickness is larger than this range, the rebound on W#1 shots and iron shots may be inadequate and the spin rate may increase, as a result of which a good distance may not be obtained. On the other hand, when the cover is thinner than this range, the scuff resistance worsens and the ball may not be receptive to spin on approach shots, resulting in a poor controllability.

The cover-encased sphere, i.e., the ball, has a deflection (mm) when compressed under a final load of 1,275 N (130 kgf) from an initial load of 98 N (10 kgf) which, although not particularly limited, is preferably from 2.1 to 3.6 mm, more preferably from 2.3 to 3.3 mm, and even more preferably from 2.5 to 3.0 mm. When this value is too large, the feel of the ball may be too soft, the durability to repeated impact may worsen, or the initial velocity on full shots may be low, as a result of which the intended distance may not be obtained. On the other hand, when this value is too small, the feel of the ball may be too hard and the spin rate on full shots may rise, as a result of which the intended distance may not be obtained.

The cover (outermost layer) material is not particularly limited, although the use of any of various types of thermoplastic resin materials is preferred. For reasons having to do with controllability and scuff resistance, it is preferable to use a urethane resin as the cover material of the invention. In particular, from the standpoint of the mass productivity of manufactured golf balls, it is preferable to use a cover material composed primarily of a thermoplastic polyurethane, with formation more preferably being carried out using a resin blend composed primarily of (O) a thermoplastic polyurethane and (P) a polyisocyanate compound.

In the thermoplastic polyurethane composition containing above components (O) and (P), to improve the ball properties even further, a necessary and sufficient amount of unreacted isocyanate groups should be present in the cover resin material. Specifically, it is recommended that the combined weight of above components (O) and (P) be at least 60%, and more preferably at least 70%, of the weight of the overall cover layer. Components (O) and (P) are described below in detail.

The thermoplastic polyurethane (O) has a structure which includes soft segments composed of a polymeric polyol (polymeric glycol) that is a long-chain polyol, and hard segments composed of a chain extender and a polyisocyanate compound. Here, the long-chain polyol serving as a starting material may be any that has hitherto been used in the art relating to thermoplastic polyurethanes, and is not particularly limited. Illustrative examples include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly, or two or more may be used in combination. Of these, in terms of being able to synthesize a thermoplastic polyurethane having a high rebound resilience and excellent low-temperature properties, a polyether polyol is preferred.

Any chain extender that has hitherto been employed in the art relating to thermoplastic polyurethanes may be advantageously used as the chain extender. For example, low-molecular-weight compounds with a molecular weight of 400 or less which have on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these, an aliphatic diol having 2 to 12 carbons is preferred, and 1,4-butylene glycol is more preferred, as the chain extender.

Any polyisocyanate compound hitherto employed in the art relating to thermoplastic polyurethanes may be advantageously used without particular limitation as the polyisocyanate compound. For example, use may be made of one, two or more selected from the group consisting of 4,4'-diphenylmethane diisocyanate, 2,4-toluene diisocyanate, 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. However, depending on the type of isocyanate, the crosslinking reaction during injection molding may be difficult to control. In the practice of the invention, to provide a balance between stability at the time of production and the properties that are manifested, it is most preferable to use the following aromatic diisocyanate: 4,4'-diphenylmethane diisocyanate.

Commercially available products may be used as the thermoplastic polyurethane serving as component (0). Illustrative examples include Pandex T-8295, T-8290, T-8283 and T-8260 (all from DIC Bayer Polymer, Ltd.).

Although not an essential ingredient, a thermoplastic elastomer other than the above thermoplastic polyurethane may be included as an additional component together with components (0) and (P). By including this component (Q) in the above resin blend, a further improvement in the flowability of the resin blend can be achieved and the properties required of a golf ball cover material, such as resilience and scuff resistance, can be enhanced.

The relative proportions of above components (O), (P) and (Q) are not particularly limited. However, to fully elicit the desirable effects of the invention, the weight ratio (O):(P):(Q) is preferably from 100:2:50 to 100:50:0, and more preferably from 100:2:50 to 100:30:8.

In addition to the ingredients making up the thermoplastic polyurethane, various additives may be optionally included in the above resin blend. For example, pigments, dispersants, antioxidants, light stabilizers, ultraviolet absorbers and internal mold lubricants may be suitably included.

The manufacture of multi-piece solid golf balls in which the above-described two-layer core (inner core layer and outer core layer), intermediate layer and cover (outermost layer) are formed as successive layers may be carried out by a customary method such as a known injection-molding process. For example, a multi-piece solid golf ball may be obtained by placing a two-layer core in a given injection mold, injecting an intermediate layer material over the core to give an intermediate sphere, and subsequently placing the resulting sphere in another injection mold and injection-molding a cover (outermost layer) material over the sphere. Alternatively, a cover may be formed over the intermediate layer by a method that involves encasing the intermediate layer-encased sphere with a cover (outermost layer), this being carried out by, for example, enclosing the intermediate sphere within two half-cups that have been pre-molded into hemispherical shapes, and then molding under applied heat and pressure.

The golf ball of the invention preferably satisfies the following conditions.

(1) Relationship Between Deflections of Inner Core Layer and Intermediate Layer-Encased Sphere Under Specific Loading Letting E be the deflection (mm) of the inner core layer when compressed under a final load of 1,275 N from an initial load of 98N, and G be the deflection (mm) of the intermediate layer-encased sphere when compressed under a final load of 1,275 N from an initial load of 98 N, the value E/G is preferably not more than 2.0, more preferably from 1.2 to 1.7, and even more preferably from 1.4 to 1.5. When this value is too small, the feel at impact may be too hard and the spin rate on full shots may rise excessively, as a result of which the intended distance on driver (W#1) shots may not be obtained. On the other hand, when the value E/G is too large, the feel at impact may be too soft and the initial velocity on full shots may be low, as a result of which the intended distance on driver (W#1) shots may not be obtained.

(2) Relationship Between Deflections of Inner Core Layer and Ball Under Specific Loading Letting E be the deflection (mm) of the inner core layer when compressed under a final load of 1,275 N from an initial load of 98N, and H be the deflection (mm) of the golf ball when compressed under a final load of 1,275 N from an initial load of 98 N, the value E/H is preferably not more than 2.1, more preferably from 1.2 to 1.9, and even more preferably from 1.5 to 1.7. When this value is too small, the feel at impact may be too hard and the spin rate on full shots may rise excessively, as a result of which the intended distance on driver (W#1) shots may not be obtained. On the other hand, when the value E/H is too large, the feel at impact may be too soft and the initial velocity on full shots may be low, as a result of which the intended distance on driver (W#1) shots may not be obtained.

Also, the value E−H is preferably from 0.8 to 2.5, more preferably from 1.0 to 2.2 mm, and even more preferably from 1.3 to 2.0 mm. When this value is too small, the spin rate on full shots may rise excessively, as a result of which the intended distance on shots with a driver may not be obtained. On the other hand, when this value is too large, the initial velocity on full shots may be too low, as a result of which the intended distance on shots with a driver may not be obtained.

(3) Relationship Between Surface Hardnesses of Outer Core Layer and Intermediate Layer-Encased Sphere The relationship between the surface hardnesses of the outer core layer and the intermediate layer-encased sphere is optimized within a specific range. That is, the value obtained by subtracting the surface hardness of the outer core layer from the surface hardness of the intermediate layer-encased sphere, expressed in terms of Shore D hardness, is preferably from 1 to 20, more preferably from 3 to 16, and even more preferably from 5 to 13. When this value falls outside of the foregoing range, the spin rate-lowering effect on full shots may be inadequate, as a result of which the intended distance may not be obtained, or the durability to cracking under repeated impact may worsen.

(4) Relationship Between Surface Hardnesses of Ball and Intermediate Layer-Encased Sphere The value obtained by subtracting the surface hardness of the intermediate layer-encased sphere from the surface hardness of the ball, expressed in terms of Shore D hardness, is preferably from −18 to −1, more preferably from −15 to −3, and even more preferably from −12 to −5. When this value is too large, the ball may not be receptive to spin on approach shots, or the durability to cracking on repeated impact may worsen. On the other hand, when this value is too small (too large in the negative direction), the spin rate on full shots may rise or the initial velocity of the ball may be low, as a result of which the intended distance may not be obtained.

(5) Thickness Relationship Between Intermediate Layer and Cover

It is preferable for the thickness of the intermediate layer to be smaller than the thickness of the cover; that is, for the intermediate layer to be formed so as to be thicker than the cover. The value obtained by subtracting the cover thickness from the intermediate layer thickness is preferably from 0.1 to 1.0 mm, more preferably from 0.2 to 0.8 mm, and even more preferably from 0.3 to 0.6 mm. When this value is too large, the feel at impact may become too hard, or the ball may have a poor receptivity to spin on approach shots. On the other hand, when this value is too small, the durability to cracking on repeated impact may worsen, or the spin rate-lowering effect on full shots may be inadequate, as a result of which the intended distance may not be obtained.

Numerous dimples may be formed on the outer surface of the cover (outermost layer). The number of dimples arranged on the cover surface, although not particularly limited, may be set to preferably at least 250, and more preferably at least 300, with the upper limit being preferably not more than 500, and more preferably not more than 450.

The dimple surface coverage SR (i.e., the ratio of the sum of the individual dimple areas with respect to the total surface area of the hypothetical sphere were the ball assumed to have no dimples thereon) is set to preferably at least 70%, more preferably at least 75%, and even more preferably at least 80%. The maximum dimple surface coverage SR, although not particularly limited, is preferably not more than 99%. It is especially desirable for the ball to be provided with at least three types of dimples of differing size, and for the dimples to be thereby uniformly arranged on the spherical surface of the ball without leaving gaps.

The dimple volume occupancy VR (i.e., the sum of the volumes of the individual dimples, each formed below the flat plane circumscribed by the edge of a dimple, expressed as a ratio with respect to the volume of the hypothetical sphere were the ball assumed to have no dimples thereon) is set to preferably at least 0.75%, more preferably at least 0.80%, and even more preferably at least 1.1%. The upper limit in the dimple volume occupancy VR is preferably not more than 1.5%, and more preferably not more than 1.4%.

Although the dimple shapes are not particularly limited, by giving the base of a dimple a specific shape in which the center of the dimple curves upward toward the outside of the golf ball, the ball can be imparted with the subsequently described specific pressed area without a loss of the aerodynamic performance inherent to the dimples. In this dimple shape, the portion having an upwardly curved shape can, moreover, be given a flat shape in the central region thereof. Beveling the corner on the outer edge portion of this flat region can effectively increase the contact area when the ball is struck with a golf club.

The relationship between the pressed area, the hypothetical planar surface area and the deflection of the golf ball is preferably set within the following ranges.

The golf ball of the invention preferably satisfies the condition $$PS_7/S/H\times100\geq5.70(\mathrm{mm}^{-1}),$$

and more preferably satisfies the condition $$PS_7/S/H\times100\geq6.70(\mathrm{mm}^{-1}),$$

where $PS_7$ is the pressed area ($mm^2$), defined as the area of the golf ball that comes into contact with a flat surface, when the ball is subjected to a load of 6,864 N (700 kgf), S is the hypothetical planar area ($mm^2$) of the ball, defined as the surface area of a cross-sectional circle along the ball diameter were the surface of the ball to be entirely free of dimples, and H is the deflection (mm) of the ball when compressed under a final load of 1,275 N (130 kgf) from an initial load of 98 N (10 kgf).

By having the pressed area of the golf ball under loading on a driver shot by an ordinary golfer satisfy the above condition, the surface area of contact between the ball and golf club increases and frictional forces with the club rise, as a result of which the amount of back spin on driver shots decreases, enabling the distance to be improved.

The golf ball of the invention also preferably satisfies the condition $$PS_2/S/H\times100\geq1.70(\mathrm{mm}^{-1}),$$

and more preferably satisfies the condition $$PS_2/S/H\times100\geq1.90(\mathrm{mm}^{-1}),$$

where $PS_2$ is the pressed area ($mm^2$), defined as the area of the golf ball that comes into contact with a flat surface, when the ball is subjected to a load of 1,961 N (200 kgf), S is the hypothetical planar area ($mm^2$) of the ball, defined as the surface area of a cross-sectional circle along the ball diameter were the surface of the ball to be entirely free of dimples, and H is the deflection (mm) of the ball when compressed under a final load of 1,275 N (130 kgf) from an initial load of 98 N (10 kgf).

By having the pressed area of the golf ball under loading on an approach shot by an ordinary golfer satisfy the above condition, the surface area of contact between the ball and golf club increases and frictional forces with the club rise, as a result of which the amount of back spin on approach shots increases, enabling movement of the ball to be stopped in a straighter line near the landing point of the ball.

The hypothetical planar surface area S of the golf ball is determined by the ball diameter. The diameter may be set in conformity with the Rules of Golf for play, this being of a size such that the ball does not pass through a ring having an inside diameter of 42.672 mm and is not more than 42.80 mm.

Figure 4A:
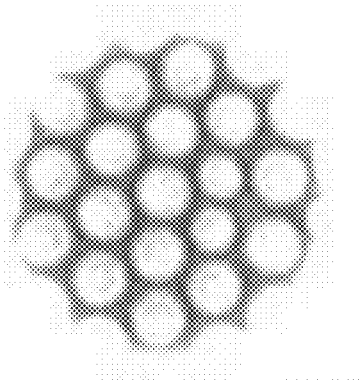
FIGS. 4A and 4B show explanatory diagrams for a method of determining the pressed area of a golf ball.
Figure 4B:
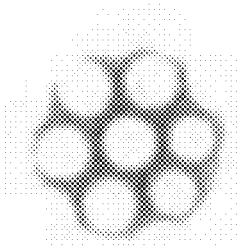

The pressed areas $PS_7$ and $PS_2$ of the golf ball under predetermined loads represent the areas of contact by the golf ball with the golf club at the time of given shots. These areas of contact can be made larger than in the prior art by means of the dimple structure. However, the pressed area PS is dependent on the size of the golf ball, becoming larger when the size of the golf ball is larger and smaller when the size of the golf ball is smaller. Accordingly, by dividing the pressed area by the hypothetical planar surface area S and expressing the result as a percentage, it is possible to evaluate the increase in the area of contact due to the dimple construction without being influenced by the size of the golf ball. The pressed area PS is also dependent on the deflection H of the golf ball, becoming larger when the deflection H is larger, and smaller when the deflection H is smaller. Therefore, by dividing the pressed area by the deflection H, it is possible to evaluate the increase in the area of contact due to the dimple construction without being influenced by the amount of golf ball deflection. Measurement of the pressed area may be carried out by, for example, placing pressure-sensitive paper on a flat surface, setting the golf ball to be tested on the paper, applying a load of 6,864 N or 1,961 N to the golf ball, and measuring the total area of the portion of the pressure-sensitive paper that has become colored as a result of contact with the golf ball. FIG. 4A shows a real example of pressure-sensitive paper that was colored when a load of 6,864 N was applied to a golf ball, and FIG. 4B shows a real example of pressure-sensitive paper that was colored when a load of 1,961 N (200 kgf) was applied to the same golf ball. In these diagrams, the round areas are dimples, and the solid (blackened) places indicate the colored portions. The area of the colored portions can be easily determined using a commercial pressure image analysis system.

In this invention, a paint film layer is formed on the cover surface. A two-part curable urethane paint may be suitably used as the paint that forms the paint film layer. Specifically, in this case, the two-part curable urethane paint includes a base resin composed primarily of a polyol resin and a curing agent composed primarily of a polyisocyanate.

A known method may be used without particular limitation as the method of applying this paint onto the cover surface and forming a paint film layer. Use can be made of a desired method such as air gun painting or electrostatic painting.

The thickness of the paint film layer, although not particularly limited, is generally from 8 to 22 μm, and preferably from 10 to 20 μm.

The paint film layer has an elastic work recovery of preferably 30 to 98%, and more preferably 70 to 90%. When the elastic work recovery of the paint film layer is within the above range, the paint film formed on the golf ball surface has a high self-repairing ability while maintaining a certain hardness and elasticity and is thus able to contribute to excellent ball durability and scuff resistance. When the elastic work recovery of this paint film layer falls outside of the above range, a sufficient spin rate on approach shots may not be attainable. The method of measuring this elastic work recovery is subsequently described.

The elastic work recovery is one parameter of the nanoindentation method for evaluating the physical properties of paint films, which is a nanohardness test method that controls the indentation load on a micro-newton (μN) order and tracks the indenter depth during indentation to a nanometer (nm) precision. In prior methods, only the size of the deformation (plastic deformation) mark corresponding to the maximum load could be measured. However, in the nanoindentation method, the relationship between the indentation load and the indentation depth can be obtained by continuous automated measurement. Hence, unlike in the past, there are no individual differences between observers when visually measuring a deformation mark under an optical microscope, which presumably enables the physical properties of the paint film to be evaluated reliably and to a high precision. Hence, given that the paint film on the surface of the golf ball surface is strongly affected by the impact of drivers and various other clubs and has a not inconsiderable influence on various golf ball properties, measuring the golf ball paint film by the nanohardness test method and carrying out such measurement to a higher precision than in the past is a very effective method of evaluation.

The multi-piece solid golf ball of the invention can be made to conform to the Rules of Golf for use as a game ball, and can be formed to a weight of preferably from 45.0 to 45.93 g.

EXAMPLES

The following Working Examples and Comparative Examples are provided to illustrate the invention, and are not intended to limit the scope thereof.

Working Examples 1 to 4, Comparative Examples 1 to 3

Formation of Core

Solid rubber cores, each consisting of an inner layer and an outer layer, were produced in the respective Working Examples and Comparative Examples by first forming an inner core layer of the rubber composition shown in Table 1 under the vulcanization temperature and time conditions shown in Table 1, and subsequently forming over the inner core layer an outer core layer of the rubber composition shown in Table 2 under the vulcanization temperature and time conditions shown in Table 2.

TABLE 1

| | | Working Example | | | | Comparative Example | | |
|---|---|---|---|---|---|---|---|---|
| | | 1 | 2 | 3 | 4 | 1 | 2 | 3 |
| Inner core layer formulation (pbw) | Polybutadiene A | 20 | 20 | 20 | 20 | | 80 | 80 |
| | Polybutadiene B | 80 | 80 | 80 | 80 | 100 | 20 | 20 |
| | Zinc acrylate | 33 | 33 | 33 | 33 | 22 | 30 | 30 |
| | Organic peroxide (1) | 1.0 | 1.0 | 1.0 | 1.0 | | 1.0 | 1.0 |
| | Organic peroxide (2) | | | | | 1.2 | | |
| | Water | 1.0 | 1.0 | 1.0 | 1.0 | | 0.8 | 0.8 |
| | Antioxidant | 0.1 | 0.1 | 0.1 | 0.1 | 0.1 | 0.1 | 0.1 |
| | Barium sulfate | 16.1 | 16.1 | 16.1 | 16.1 | | 17.7 | 17.7 |
| | Zinc oxide | 4.0 | 4.0 | 4.0 | 4.0 | 24.3 | 4.0 | 4.0 |
| | Zinc stearate | | | | | 5.0 | | |
| | Zinc salt of pentachlorothiophenol | 0.6 | 0.6 | 0.6 | 0.6 | 2.0 | 0.2 | 0.2 |
| Vulcanization conditions | Temperature (° C.) | 155 | 155 | 155 | 155 | 155 | 155 | 155 |
| | Time (min.) | 15 | 15 | 15 | 15 | 15 | 15 | 15 |

TABLE 2

| | | Working Example | | | | Comparative Example | | |
|---|---|---|---|---|---|---|---|---|
| | | 1 | 2 | 3 | 4 | 1 | 2 | 3 |
| Outer core layer formulation (pbw) | Polybutadiene A | 100 | 100 | 100 | 100 | 100 | 100 | 100 |
| | Zinc acrylate | 32 | 29 | 29 | 29 | 33 | 21.5 | 32 |
| | Organic peroxide (1) | 0.6 | 0.6 | 0.6 | 0.6 | | 0.6 | 0.6 |
| | Organic peroxide (2) | 0.6 | 0.6 | 0.6 | 0.6 | 1.2 | 0.6 | 0.6 |
| | Antioxidant | | | | | 0.1 | | |
| | Barium sulfate | 16.6 | 16.4 | 16.4 | 16.4 | | 20.4 | 16.6 |
| | Zinc oxide | 5.0 | 5.0 | 5.0 | 5.0 | 24.9 | 5.0 | 5.0 |
| | Zinc stearate | 5.0 | 5.0 | 5.0 | 5.0 | 5.0 | 5.0 | 5.0 |
| | Zinc salt of pentachlorothiophenol | 1.0 | 1.0 | 1.0 | 1.0 | 1.0 | 1.0 | 1.0 |
| Vulcanization conditions | Temperature (° C.) | 155 | 155 | 155 | 155 | 155 | 155 | 155 |
| | Time (min.) | 10 | 10 | 10 | 10 | 10 | 10 | 10 |

Details on each of the ingredients in Tables 1 and 2 are given below.

Polybutadiene A: Available under the trade name "BR01" from JSR Corporation

Polybutadiene B: Available under the trade name "BR51" from JSR Corporation

Zinc acrylate: Available from Nippon Shokubai Co., Ltd.

Organic peroxide (1):

Dicumyl peroxide, available under the trade name "Percumyl D" from NOF Corporation Organic peroxide (2):

A mixture of 1,1-di(t-butylperoxy)cyclohexane and silica, available under the trade name "Percumyl C-40" from NOF Corporation Water: Distilled water, from Wako Pure Chemical Industries, Ltd.

Antioxidant: 2,2-Methylenebis(4-methyl-6-butylphenol), available under the trade name "Nocrac NS-6" from Ouchi Shinko Chemical Industry Co., Ltd.

Barium sulfate: Available under the trade name "Barico #300" from Hakusui Tech

Zinc oxide: Available under the trade name "Zinc Oxide Grade 3" from Sakai Chemical Co., Ltd.

Zinc stearate: Available under the trade name "Zinc Stearate G" from NOF Corporation Zinc salt of pentachlorothiophenol: Available from ZHEJIANG CHO & FU CHEMICAL.

Formation of Intermediate Layer and Cover

In each Example, an intermediate layer material formulated as shown in Table 3 was injected-molded over the two-layer core obtained above, thereby giving an intermediate layer-encased sphere. Next, using the cover material formulated as shown in Table 3, a cover (outermost layer) was injection-molded over the intermediate layer-encased sphere, thereby producing a golf ball having an intermediate layer and a cover (outermost layer) over the core.

TABLE 3

| Resin materials (pbw) | No. 1 | No. 2 | No. 3 | No. 4 |
|---|---|---|---|---|
| T-8295 | | | | 100 |
| T-8290 | | | 75 | |
| T-8283 | | | 25 | |
| Himilan ® 1706 | 35 | | | |
| Himilan ® 1557 | 15 | | | |
| Himilan ® 1605 | 50 | | | |
| AN4319 | | 20 | | |
| AN4221C | | 80 | | |
| Hytrel ® 4001 | | | 11 | 11 |

TABLE 3-continued

| Resin materials (pbw) | No. 1 | No. 2 | No. 3 | No. 4 |
|---|---|---|---|---|
| Titanium oxide | | | 3.9 | 3.9 |
| Polyethylene wax | | | 1.2 | 1.2 |
| Isocyanate compound | | | 7.5 | 7.5 |
| Trimethylolpropane | 1.1 | | | |
| Magnesium stearate | | 60 | | |
| Calcium hydroxide | | 1.5 | | |
| Magnesium oxide | | 1 | | |
| Polytail H | | 8 | | |

Details on the materials shown in Table 3 are as follows.

T-8295, T-8290, T-8283:

MDI-PTMG type thermoplastic polyurethanes available from DIC Bayer Polymer under the trademark Pandex.

Himilan® 1706, Himilan® 1557, Himilan® 1605:

Ionomers available from DuPont-Mitsui Polychemicals Co., Ltd.

AN4319: An unneutralized ethylene-methacrylic acid-ester terpolymer (from DuPont-Mitsui Polychemicals Co., Ltd.)

AN4221C: An unneutralized ethylene-acrylic acid copolymer (from DuPont-Mitsui Polychemicals Co., Ltd.)

Hytrel® 4001: A polyether ester elastomer available from DuPont-Toray Co., Ltd.

Polyethylene wax: "Sanwax 161P" from Sanyo Chemical Industries, Ltd.

Isocyanate compound: 4,4'-Diphenylmethane diisocyanate

Magnesium stearate: "Magnesium Stearate G" from NOF Corporation

Calcium hydroxide: "Calcium Hydroxide CLS-B" from Shiraishi Calcium Kaisha, Ltd.

Magnesium oxide: "Kyowamag MF 150" from Kyowa Chemical Industry Co., Ltd.

Polytail H: Available from Mitsubishi Chemical Corporation

Dimples having the parameters shown in Table 4 below were formed at this time on the cover surface in the respective Working Examples and Comparative Examples. Six types of dimples of differing diameters as shown in Table 4 were arranged on the golf balls in each of the Working Examples and Comparative Examples, and set to the same surface coverage ratio SR (%).

TABLE 4

| No. | Number of dimples | Diameter (mm) | SR (%) |
|---|---|---|---|
| 1 | 12 | 4.6 | 81 |
| 2 | 234 | 4.4 | |
| 3 | 60 | 3.8 | |

TABLE 4-continued

| No. | Number of dimples | Diameter (mm) | SR (%) |
|---|---|---|---|
| 4 | 6 | 3.5 | |
| 5 | 6 | 3.4 | |
| 6 | 12 | 2.6 | |
| Total | 330 | | |

Dimple Definitions

Diameter: Diameter of flat plane circumscribed by edge of dimple (mm).

SR: Sum of individual dimple areas as a percentage of the total surface area of a hypothetical sphere were the golf ball to have no dimples thereon (unit: %)

Two dimple shapes were used. Dimple a (FIG. 2) was used in Working Examples 1, 2 and 4 and Comparative Examples 1 to 3. Dimple b (FIG. 3) was used only in Working Example 3. Of the six types of dimples of differing diameter in Table 4, the structures of the typical dimples having a diameter of 4.4 mm were as follows.

Dimple a

Figure 2A:
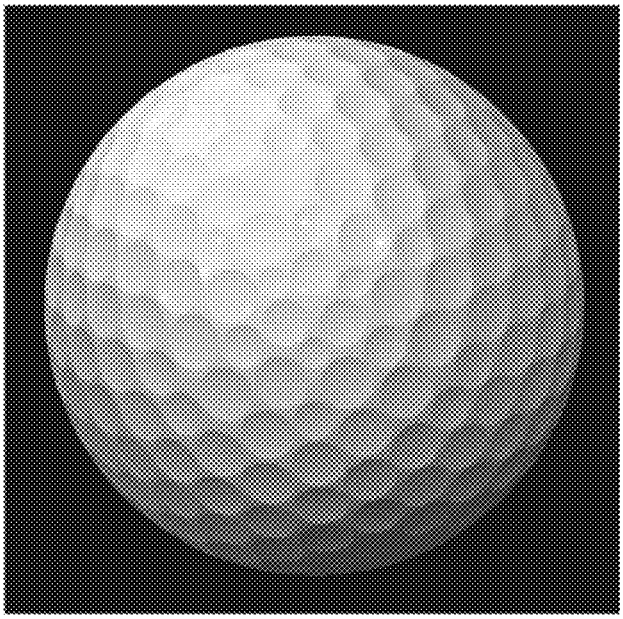
FIGS. 2A and 2B are enlarged cross-sectional diagrams of a dimple on the golf balls used in Working Examples 1, 2 and 4.
Figure 2B:
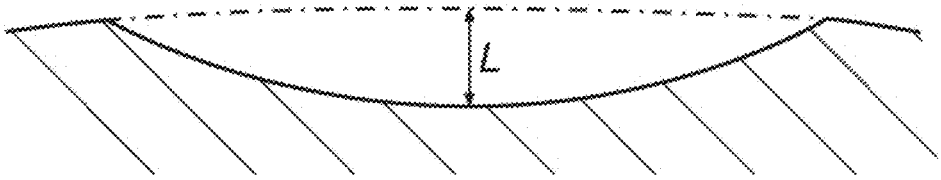

In the cross-sectional shape in FIG. 2, the depth L at the deepest point is 0.150 mm.

Dimple b

Figure 3A:
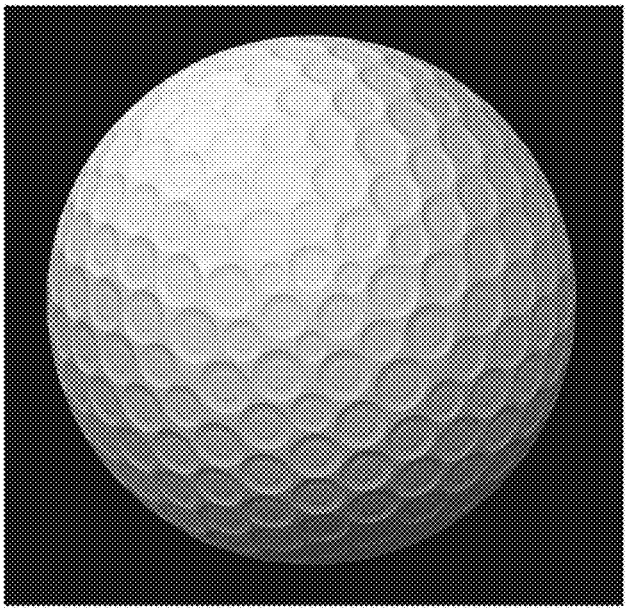
FIGS. 3A and 3B are enlarged cross-sectional diagrams of a dimple on the golf ball used in Working Example 3.
Figure 3B:
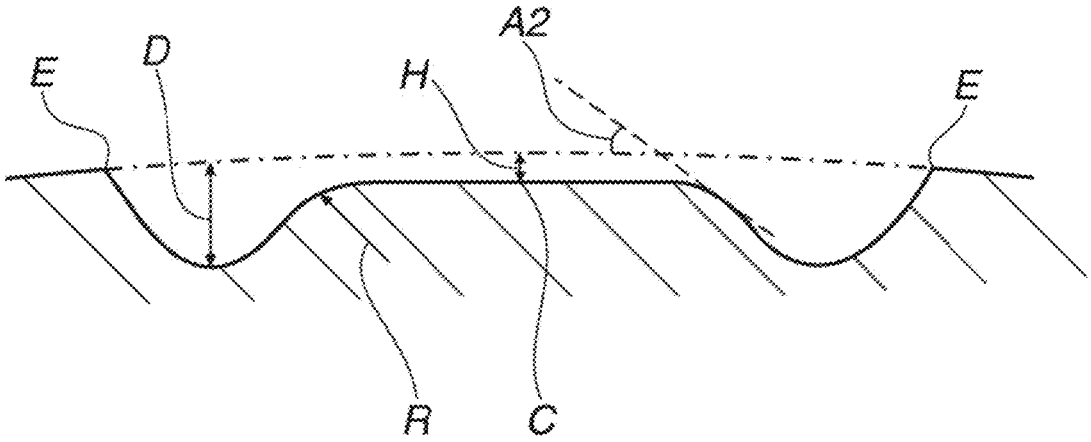

In the cross-sectional shape in FIG. 3, the depth H at the center point C is 0.097 mm, the depth D at the deepest point is 0.131 mm, the distance from the outer peripheral edge E to the position of the deepest point, relative to an arbitrary distance of 100 from the outer peripheral edge E to the center point C, is 39, the radius of curvature R is 0.5 mm, and the edge angle A2 is 10.5°.

Formation of Paint Film Layer

Next, a paint formulated as shown in Table 5 below was applied with an air spray gun onto the cover (outermost layer) surface on which numerous dimples had been formed, thereby producing a golf ball having a 15 μm thick paint film layer formed thereon.

TABLE 5

| Paint formulation (pbw) | | A | B |
|---|---|---|---|
| Base resin | Polyol (1) | 100.0 | |
| | Polyol (2) | | 100.0 |
| | Ethyl acetate | 100.0 | 60.0 |
| | Propylene glycol monomethyl ether acetate | 40.0 | 40.0 |
| | Curing catalyst | 0.03 | 0.03 |
| Curing agent | Isocyanurate form of hexamethylene diisocyanate (1) | 30.5 | 52.5 |
| | Polyester-modified hexamethylene diisocyanate (2) | 46.8 | |
| | Ethyl acetate | 42.7 | 47.5 |
| | Molar compounding ratio (NCO/OH) | 1.08 | 1.08 |

Paint formulation A (NCO molar ratio): (1):(2) = 0.79:0.29

Synthesis Examples for Acrylic Polyols 1 and 2 in Table 5 are described below. Here, all parts are given by weight.

Acrylic Polyol Synthesis Example 1

A reactor equipped with a stirrer, a thermometer, a condenser, a nitrogen gas inlet and a dropping device was charged with 1,000 parts of butyl acetate and the temperature was raised to 100° C. under stirring. Next, a mixture consisting of 220 parts of polyester-containing acrylic monomer (Placcel® FM-3, from Daicel Chemical Industries, Ltd.), 610 parts of methyl methacrylate, 170 parts of 2-hydroxyethyl methacrylate and 30 parts of 2,2'-azobisisobutyronitrile was added dropwise over 4 hours. After the end of dropwise addition, the reaction was effected for 6 hours at the same temperature. Following reaction completion, 180 parts of butyl acetate and 150 parts of polycaprolactone diol (Placcel® L205AL, from Daicel Chemical Industries, Ltd.) were charged and mixed in, giving a clear acrylic polyol resin solution (Polyol (1)) having a solids content of 50%, a viscosity of 100 mPa·s (25° C.), a weight-average molecular weight of 10,000, and a hydroxyl value of 113 mgKOH/g (solids).

Acrylic Polyol Synthesis Example 2

A reactor equipped with a stirrer, a thermometer, a condenser, a nitrogen gas inlet and a dropping device was charged with 1,000 parts of butyl acetate and the temperature was raised to 100° C. under stirring. Next, a mixture consisting of 620 parts of polyester-containing acrylic monomer (Placcel® FM-3, from Daicel Chemical Industries, Ltd.), 317 parts of methyl methacrylate, 63 parts of 2-hydroxyethyl methacrylate and 12 parts of 2,2'-azobisisobutyronitrile was added dropwise over 4 hours. After the end of dropwise addition, the reaction was effected for 6 hours at the same temperature. Following reaction completion, 532 parts of butyl acetate and 520 parts of polycaprolactone diol (Placcel® L205AL, from Daicel Chemical Industries, Ltd.) were charged and mixed in, giving a clear acrylic polyol resin solution (Polyol (2)) having a solids content of 50%, a viscosity of 600 mPa·s (25° C.), a weight-average molecular weight of 70,000, and a hydroxyl value of 142 mgKOH/g (solids).

The core hardness profiles, thicknesses and material hardnesses of the respective layers, and various properties such as the surface hardnesses of the respective layer-encased spheres were measured and evaluated by the following methods. The results are shown in Table 6.

Hardness Profile of Inner Core Layer and Surface Hardness of Outer Core Layer

The indenter of a durometer was set so as to be substantially perpendicular to the spherical surface of the inner core layer, and the surface hardness of the inner core layer (Cs) in terms of JIS-C hardness was measured as specified in JIS K6301-1975.

To obtain the center hardness of the inner core layer (Cc) and cross-sectional hardnesses at specific positions of the inner core layer (C5, C10, C15), the inner core layer was hemispherically cut so as form a planar cross-section, and measurements were carried out by pressing the indenter of a durometer perpendicularly against the cross-section at the measurement positions. These hardnesses are indicated as JIS-C hardness values.

To obtain the surface hardness of the outer core layer (Css), the indenter of a durometer was set so as to be substantially perpendicular to the surface of the outer core layer, and this hardness was measured in terms of JIS-C hardness.

In addition, the center hardness of the inner core layer (Cc) and the surface hardness of the outer core layer (Css) were measured in terms of Shore D hardness with a type D durometer in accordance with ASTM D2240-95.

Diameters of Inner Core Layer, Outer Core Layer-Encased Sphere and Intermediate Layer-Encased Sphere The diameters at five random places on the surface were measured at a temperature of 23.9±1° C. and, using the average of these measurements as the measured value for a single inner core layer, outer core layer-encased sphere (overall core) or intermediate layer-encased sphere, the average diameter for five measurement specimens was determined.

Ball Diameter

The diameters at five random dimple-free areas on the surface of a ball were measured at a temperature of 23.9±1° C. and, using the average of these measurements as the measured value for a single ball, the average diameter for five measured balls was determined.

Deflections of Inner Core Layer, Outer Core Layer-Encased Sphere, Intermediate Layer-Encased Sphere and Ball An inner core layer, outer core layer-encased sphere (overall core), intermediate layer-encased sphere or ball was placed on a hard plate and the amount of deflection when compressed under a final load of 1,275 N (130 kgf) from an initial load of 98 N (10 kgf) was measured. The amount of deflection here refers in each case to the measured value obtained after holding the test specimen isothermally at 23.9° C.

Material Hardnesses of Intermediate Layer and Cover (Shore D Hardnesses)

The intermediate layer and cover-forming resin materials were molded into sheets having a thickness of 2 mm and left to stand for at least two weeks, following which the Shore D hardnesses were measured in accordance with ASTM D2240-95.

Surface Hardnesses of Intermediate Layer-Encased Sphere and Ball (Shore D Hardnesses)

Measurements were taken by pressing the durometer indenter perpendicularly against the surface of the intermediate layer-encased sphere or of the ball (i.e., the surface of the cover). The surface hardness of the ball (cover) is the measured value obtained at dimple-free places (lands) on the ball surface. The Shore D hardnesses were measured with a type D durometer in accordance with ASTM D2240-95.

Elastic Work Recovery of Paint Film Layer

The elastic work recovery of the paint was measured using a paint film sheet having a thickness of 100 μm. The ENT-2100 nanohardness tester from Erionix Inc. was used as the measurement apparatus, and the measurement conditions were as follows.

Indenter: Berkovich indenter
(material: diamond; angle α: 65.03°)
Load F: 0.2 mN
Loading time: 10 seconds
Holding time: 1 second
Unloading time: 10 seconds The elastic work recovery was calculated as follows based on the indentation work $W_{elast}$ (Nm) due to spring-back deformation of the paint film, and on the mechanical indentation work $W_{total}$ (Nm).

$$\text{Elastic work recovery}=W_{elast}/W_{total}\times 100(\%)$$

Pressed Area

Measurement of the pressed area PS of a golf ball was carried out by placing pressure-sensitive paper (Prescale pressure measurement film for medium pressure, available from Fujifilm Corporation) on a flat surface, and setting a golf ball from the respective Working Examples and Comparative Examples thereon. Next, using a model 4204 tester from Instron Corporation, loads of 6,864 N (700 kgf) and 1,961 N (200 kgf) were applied to these golf balls, and the total area of the portion of the pressure-sensitive paper that became colored due to contact with the golf ball was measured. The area of the colored portion was determined using the FPD-9270 Prescale Pressure Image Analysis System (Fujifilm Corporation). In each case, the pressed area is the result of measurement at a single arbitrary position on the golf ball.

TABLE 6

| | | | Working Example | | | | Comparative Example | | |
|---|---|---|---|---|---|---|---|---|---|
| | | | 1 | 2 | 3 | 4 | 1 | 2 | 3 |
| Inner core layer | | Material | rubber | rubber | rubber | rubber | rubber | rubber | rubber |
| | | Diameter (mm) | 35.20 | 35.20 | 35.20 | 35.20 | 21.50 | 35.20 | 35.20 |
| | | Weight (g) | 26.5 | 26.5 | 26.5 | 26.5 | 6.0 | 26.5 | 26.5 |
| | | Deflection (mm) | 4.4 | 4.4 | 4.4 | 4.4 | 6.0 | 4.3 | 4.3 |
| | Hardness profile | Center hardness: Cc (JIS-C) | 55 | 55 | 55 | 55 | 55 | 53 | 53 |
| | | (Shore D) | 34 | 34 | 34 | 34 | 34 | 32 | 32 |
| | | Hardness at position 5 mm from center: C5 (JIS-C) | 58 | 58 | 58 | 58 | 60 | 61 | 61 |
| | | Hardness at position 10 mm from center: C10 (JIS-C) | 59 | 59 | 59 | 59 | 60 | 64 | 64 |
| | | Hardness at position 15 mm from center: C15 (JIS-C) | 72 | 72 | 72 | 72 | — | 78 | 78 |
| | | Surface hardness: Cs (JIS-C) | 81 | 81 | 81 | 81 | 72 | 82 | 82 |
| | | C10 − Cc (JIS-C) | 4 | 4 | 4 | 4 | 5 | 11 | 11 |
| | | C5 − Cc (JIS-C) | 3 | 3 | 3 | 3 | 5 | 8 | 8 |
| | | C10 − C5 (JIS-C) | 1 | 1 | 1 | 1 | 0 | 3 | 3 |
| | | C15 − C10 (JIS-C) | 13 | 13 | 13 | 13 | — | 14 | 14 |
| | | Cs − C15 (JIS-C) | 9 | 9 | 9 | 9 | — | −3 | 13 |
| | | Cs − Cc (JIS-C) | 26 | 26 | 26 | 26 | 17 | 29 | 29 |
| Outer core layer | | Material | rubber | rubber | rubber | rubber | rubber | rubber | rubber |
| | | Thickness (mm) | 1.67 | 1.67 | 1.67 | 1.67 | 8.50 | 1.67 | 1.67 |
| Outer core layer-encased sphere | | Diameter (mm) | 38.54 | 38.54 | 38.54 | 38.54 | 38.50 | 38.54 | 38.54 |
| | | Weight (g) | 34.8 | 34.8 | 34.8 | 34.8 | 34.8 | 34.8 | 34.8 |
| | | Specific gravity | 1.159 | 1.159 | 1.159 | 1.159 | 1.159 | 1.159 | 1.159 |
| | | Deflection (mm) | 3.6 | 3.7 | 3.7 | 3.7 | 3.7 | 3.9 | 3.6 |
| | Hardness profile | Surface hardness: Css (JIS-C) | 91 | 86 | 86 | 86 | 84 | 75 | 91 |
| | | (Shore D) | 61 | 57 | 57 | 57 | 56 | 49 | 61 |
| | | Outer core layer surface − Inner core layer center: Css − Cc (JIS-C) | 36 | 31 | 31 | 31 | 29 | 22 | 38 |
| | | (Shore D) | 27 | 23 | 23 | 23 | 22 | 17 | 29 |
| | | Css − C10 (JIS-C) | 32 | 27 | 27 | 27 | 24 | 11 | 27 |
| | | (Css − C10)/(C10 − Cc) | 8.8 | 7.4 | 7.4 | 7.4 | 4.8 | 1.0 | 2.5 |
| | (Deflection of inner core layer)/ (Deflection of outer core layer-encased sphere) | | 1.2 | 1.2 | 1.2 | 1.2 | 1.6 | 1.1 | 1.2 |

TABLE 6-continued

| | | Working Example | | | | Comparative Example | | |
|---|---|---|---|---|---|---|---|---|
| | | 1 | 2 | 3 | 4 | 1 | 2 | 3 |
| Intermediate layer | Material | No. 1 | No. 1 | No. 1 | No. 1 | No. 1 | No. 1 | No. 2 |
| | Thickness (mm) | 1.26 | 1.26 | 1.26 | 1.26 | 1.28 | 1.26 | 1.26 |
| | Specific gravity | 0.95 | 0.95 | 0.95 | 0.95 | 0.95 | 0.95 | 0.95 |
| | Material hardness (Shore D) | 62 | 62 | 62 | 62 | 62 | 62 | 55 |
| Intermediate layer-encased sphere | Diameter (mm) | 41.06 | 41.06 | 41.06 | 41.06 | 41.06 | 41.06 | 41.06 |
| | Weight (g) | 40.7 | 40.7 | 40.7 | 40.7 | 40.8 | 40.7 | 40.7 |
| | Deflection (mm) | 2.9 | 3.0 | 3.0 | 3.0 | 3.0 | 3.2 | 3.1 |
| | Surface hardness (Shore D) | 68 | 68 | 68 | 68 | 68 | 68 | 61 |
| | Surface hardness of intermediate layer − Surface hardness of outer core layer (Shore D) | 7 | 11 | 11 | 11 | 12 | 19 | 0 |
| | (Deflection of inner core layer)/(Deflection of intermediate layer-encased sphere) | 1.5 | 1.5 | 1.5 | 1.5 | 2.0 | 1.3 | 1.4 |
| Cover | Material | No. 3 | No. 3 | No. 3 | No. 3 | No. 3 | No. 3 | No. 4 |
| | Thickness (mm) | 0.82 | 0.82 | 0.82 | 0.82 | 0.82 | 0.82 | 0.82 |
| | Specific gravity | 1.15 | 1.15 | 1.15 | 1.15 | 1.15 | 1.15 | 1.15 |
| | Material hardness (Shore D) | 47 | 47 | 47 | 47 | 47 | 47 | 56 |
| Paint film | Formulation | A | A | A | B | A | A | A |
| | Elastic work recovery (%) | 16.3 | 16.3 | 16.3 | 80.1 | 16.3 | 16.3 | 16.3 |
| | Thickness (μm) | 15 | 15 | 15 | 15 | 15 | 15 | 15 |
| | Dimples | a | a | b | a | a | a | a |
| Ball | Diameter (mm) | 42.70 | 42.70 | 42.70 | 42.70 | 42.70 | 42.70 | 42.70 |
| | Weight (g) | 45.7 | 45.7 | 45.7 | 45.7 | 45.7 | 45.7 | 45.7 |
| | Deflection (mm) | 2.6 | 2.7 | 2.7 | 2.7 | 2.7 | 2.9 | 2.9 |
| | Surface hardness (Shore D) | 59 | 59 | 59 | 59 | 59 | 59 | 67 |
| | (Deflection of inner core layer)/(Ball deflection) | 1.7 | 1.6 | 1.6 | 1.6 | 2.2 | 1.5 | 1.5 |
| | Ball surface hardness − Intermediate layer surface hardness (Shore D) | −9 | −9 | −9 | −9 | −9 | −9 | 6 |
| | Intermediate layer thickness − Cover thickness (mm) | 0.44 | 0.44 | 0.44 | 0.44 | 0.46 | 0.44 | 0.44 |
| | Inner core layer deflection − Ball deflection (mm) | 1.8 | 1.7 | 1.7 | 1.7 | 3.3 | 1.4 | 1.4 |
| | S: Hypothetical planar area ($mm^2$) | 1432 | 1432 | 1432 | 1432 | 1432 | 1432 | 1432 |
| | PS7: Pressed area when loaded at 6,864 N ($mm^2$) | 228.3 | 235.6 | 266.4 | 235.6 | 235.3 | 249.9 | 250.0 |
| | PS2: Pressed area when loaded at 1,961 N (mm) | 67.9 | 70.3 | 78.8 | 70.3 | 70.2 | 74.9 | 74.9 |
| | Formula 1: PS7/S/H × 100 ($mm^{-1}$) | 6.13 | 6.09 | 6.89 | 6.09 | 6.09 | 6.02 | 6.02 |
| | Formula 2: PS2/S/H × 100 ($mm^{-1}$) | 1.82 | 1.82 | 2.04 | 1.82 | 1.82 | 1.80 | 1.80 |

In addition, the flight performance (W#1), spin performance on approach shots and appearance of the paint film for the golf balls in the respective Examples of the invention and the Comparative Examples were evaluated according to the criteria indicated below. The results are shown in Table 7.

Flight Performance (W#1 Shots)

A driver (W#1) was mounted on a golf swing robot, and the distance traveled by the ball when struck at a head speed (HS) of 45 m/s was measured and rated according to the criteria shown below. The club used was a TourStage X-Drive709 D430 driver (2013 model, loft angle, 9.5°). The above head speed corresponds to an average head speed for mid- to high-level golfers.

Rating Criteria

Good: Total distance was 225.0 m or more

NG: Total distance was less than 225.0 m

Spin Performance on Approach Shots

A sand wedge was mounted on a golf swing robot, and the spin rate of the ball when hit at a head speed (HS) of 20 m/s was measured.

Rating Criteria

Good: Spit rate was 5,900 rpm or more

NG: Spin rate was less than 5,900 rpm

Paint Film Appearance (Evaluation of Ball Surface Appearance after Sand Abrasion Test)

A pot mill with an outside diameter of 210 mm was charged with about 4 kg of sand having a size of about 5 mm, and 15 golf balls were placed in the mill. The balls were stirred in the mill at a speed of about 50 to 60 rpm for 120 minutes, following which the balls were removed from the mill and the appearance of each ball was rated according to the following criteria.

Rating Criteria

Exc: Ball surface was free of conspicuous peeling, blemishes, etc.

Good: Ball surface had a slight but acceptable degree of blemishes due to abrasion, diminished gloss, etc.

NG: Ball surface had conspicuous peeling or blemishes due to abrasion, diminished gloss, etc.

TABLE 7

| | | Working Example | | | | Comparative Example | | |
|---|---|---|---|---|---|---|---|---|
| | | 1 | 2 | 3 | 4 | 1 | 2 | 3 |
| Flight performance (W#1; HS, 45 m/s) | Spin rate (rpm) | 3,103 | 3,133 | 3,061 | 3,101 | 3,200 | 3,280 | 3,065 |
| | Total distance (m) | 225.9 | 225.4 | 225.8 | 225.6 | 223.9 | 221.5 | 226.6 |
| | Rating | good | good | good | good | NG | NG | good |

TABLE 7-continued

| | | Working Example | | | | Comparative Example | | |
|---|---|---|---|---|---|---|---|---|
| | | 1 | 2 | 3 | 4 | 1 | 2 | 3 |
| Spin performance on approach shots | Spin rate (rpm) | 6,144 | 6,105 | 6,177 | 6,116 | 6,100 | 6,066 | 5,734 |
| | Rating | good | good | good | good | good | good | NG |
| Paint film appearance (after sand abrasion test) | Rating | good | good | good | Exc | good | good | good |

The following observations are based on the test results in Table 7.

In Comparative Example 1, the (Css−C10)/(C10−Cc) value in the core hardness profile was small. As a result, the spin rate-lowering effect on shots with a driver (W#1) was inadequate and a good distance was not obtained.

In Comparative Example 2, the (Css−C10)/(C10−Cc) value in the core hardness profile was small and the hardness difference (Css−Cc) between the outer core layer surface and the inner core layer center was small. As a result, the spin rate-lowering effect on shots with a driver (W#1) was inadequate and a good distance was not obtained.

In Comparative Example 3, the cover hardness was higher than the intermediate layer hardness, and so the surface hardness of the ball was higher than the surface hardness of the sphere consisting of the core encased by the intermediate layer. As a result, the ball was not receptive to spin on approach shots, and the desired spin effect on approach shots was not obtained.

Japanese Patent Application No. 2015-221950 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a two-layer core consisting of an inner layer and an outer layer, a cover, at least one intermediate layer between the core and the cover, and a paint film layer formed on a surface of the cover, wherein each layer of the two-layer core is formed primarily of a rubber composition; the intermediate layer and the cover are each formed primarily of a resin material; the core has a hardness profile which satisfies the conditions:

$$Css-Cc \geq 25, \text{ and} \quad \text{(i)}$$

$$(Css-C10)/(C10-Cc) \geq 5.0, \quad \text{(ii)}$$

where Cc is the JIS-C hardness at a center of the inner core layer, C10 is the JIS-C hardness at a position 10 mm from the center of the inner core layer, Cs is the JIS-C hardness at a surface of the inner core layer, and Css is the JIS-C hardness at a surface of the outer core layer; and a sphere consisting of the core encased by the intermediate layer has a surface hardness which is higher than a surface hardness of the ball; and wherein the thickness of the outer core layer is from 0.5 to 1.67 mm.

2. The golf ball of claim 1 which, in the core hardness profile, further satisfies the condition:

$$Cs-Cc \geq 20. \quad \text{(iii)}$$

3. The golf ball of claim 1 which, in the core hardness profile, further satisfies the conditions:

$$0 \leq C10-Cc \leq 10, \text{ and} \quad \text{(iv)}$$

$$20 \leq Css-C10, \quad \text{(v)}$$

with the provisos that Css≥80 and Cc≥50.

4. The golf ball of claim 1, wherein (Css−C10)/(C10−Cc) in condition (ii) of the core hardness profile has an upper limit value of 10.

5. The golf ball of claim 1, wherein Css−Cc in condition (i) of the core hardness profile has an upper limit value of 45.

6. The golf ball of claim 1 which, in the core hardness profile, further satisfies the condition:

$$(C10-C5)(C5-Cc)(C15-C10), \quad \text{(vi)}$$

where C5 is the JIS-C hardness at a position 5 mm from the center of the inner core layer, and C15 is the JIS-C hardness at a position 15 mm from the center of the inner core layer.

7. The golf ball of claim 1 which satisfies the relationship:

$$E/G \leq 2.0,$$

where E is the deflection of the inner core layer and G is the deflection of the sphere consisting of the core encased by the intermediate layer, when respectively compressed under a final load of 1,275 N from an initial load of 98 N.

8. The golf ball of claim 7 which further satisfies the following three relationships:

$$E/F \leq 1.5$$

$$E/H \leq 2.1, \text{ and}$$

$$E-H \leq 2.5,$$

where F is the deflection of the core having an inner layer and an outer layer and H is the deflection of the golf ball, when respectively compressed under a final load of 1,275 N from an initial load of 98 N.

9. The golf ball of claim 1 which satisfies the condition: $PS_7/S/H \times 100 \geq 6.70$ ($mm^{-1}$), where $PS_7$ is the pressed area ($mm^2$), defined as the area of the ball that comes into contact with a flat surface when the ball is subjected to a load of 6,864 N (700 kgf), S is the hypothetical planar area ($mm^2$) of the ball, defined as the area of a cross-sectional circle along the ball diameter were the surface of the ball to be entirely free of dimples, and H is the deflection (mm) of the ball when compressed under a final load of 1,275 N from an initial load of 98 N.

10. The golf ball of claim 1 which satisfies the condition:

$$PS_2/S/H\times100\geq1.90(\mathrm{mm}^{-1}),$$

where $PS_2$ is the pressed area ($mm^2$), defined as the area of the ball that comes into contact with a flat surface when the ball is subjected to a load of 1,961 N (200 kgf), S is the hypothetical planar area ($mm^2$) of the ball, defined as the area of a cross-sectional circle along the ball diameter were the surface of the ball to be entirely free of dimples, and H is the deflection (mm) of the ball when compressed under a final load of 1,275 N from an initial load of 98 N.

11. The golf ball of claim 1, wherein the paint film layer has an elastic work recovery of from 70 to 98%.

12. The golf ball of claim 1, wherein the inner core layer has a diameter of from 35.2 to 40 mm.

13. The golf ball of claim 1, wherein the inner core layer is formed of a material molded under heat from a rubber composition which includes (A) a base rubber, (B) an organic oxide, and (C) water and/or a metal monocarboxylate.

14. The golf ball of claim 13, wherein the rubber composition comprises water and the amount of water included per 100 parts by weight of the base rubber is from 0.1 to 5 parts by weight.

15. The golf ball of claim 1, wherein a value obtained by subtracting the surface hardness of the outer core layer from the surface hardness of the intermediate layer-encased sphere, expressed in terms of Shore D hardness, is from 7 to 20.

16. The golf ball of claim 1, wherein a value obtained by subtracting the surface hardness of the intermediate layer-encased sphere from the surface hardness of the ball, expressed in terms of Shore D hardness, is from −18 to −5.

* * * * *